US012031335B2

(12) United States Patent
Steffes et al.

(10) Patent No.: US 12,031,335 B2
(45) Date of Patent: Jul. 9, 2024

(54) SIDING LOCK REPAIR CLIP AND METHOD OF INSTALLATION

(71) Applicant: CertainTeed LLC, Malvern, PA (US)

(72) Inventors: Stephen W. Steffes, McPherson, KS (US); Robert D. Shaw, Parma, MI (US); Gregory F. Jacbos, Oreland, PA (US); Michael J. Lembo, Souderton, PA (US)

(73) Assignee: CertainTeed LLC, Malvern, PA (US)

( * ) Notice: Subject to any disclaimer, the term of this patent is extended or adjusted under 35 U.S.C. 154(b) by 161 days.

(21) Appl. No.: 17/239,930

(22) Filed: Apr. 26, 2021

(65) Prior Publication Data

US 2021/0332594 A1 Oct. 28, 2021

Related U.S. Application Data

(60) Provisional application No. 63/015,301, filed on Apr. 24, 2020.

(51) Int. Cl.
*E04F 13/08* (2006.01)
*E04B 1/38* (2006.01)

(52) U.S. Cl.
CPC ..... *E04F 13/0848* (2013.01); *E04B 1/388* (2023.08)

(58) Field of Classification Search
CPC ..... E04B 1/388; E04F 13/0848
USPC ..... 52/506.05
See application file for complete search history.

(56) References Cited

U.S. PATENT DOCUMENTS 3,365,223 A * 1/1968 Bisbing ..... E05B 65/0817 292/65
3,661,410 A * 5/1972 Larson ..... E05B 65/0817 52/582.2
3,784,240 A * 1/1974 Berkowitz ..... E04B 1/6183 403/326
4,392,281 A * 7/1983 Metz ..... E05B 65/0817 292/111
4,417,430 A * 11/1983 Loikitz ..... F25D 23/065 52/582.2
4,507,010 A * 3/1985 Fujiya ..... E04B 1/6183 403/323

(Continued)

OTHER PUBLICATIONS

CertainTeed Corporation, "Installation Instructions—Replacing a Damaged Cedar Impressions® Panel," Aug. 2008.

*Primary Examiner* — James J Buckle, Jr.
(74) *Attorney, Agent, or Firm* — McDonnell Boehnen Hulbert & Berghoff LLP

(57) ABSTRACT

The present disclosure relates generally to siding, for example, suitable for covering the exterior surface of a building. The present disclosure relates more particularly to a siding repair clip including a hub configured to be secured to a replacement siding panel so as to be rotatable with respect to the replacement siding panel. The siding repair clip also includes a leg extending from the hub in a first radial direction and configured to engage with a lip of a bottom lock of an upper siding panel. A positioning member extends from the hub in a second radial direction and includes a first detent configured to impede rotation of the hub with respect to the replacement siding panel. The siding repair clip further includes a rotating member configured to rotate the siding repair clip about the hub in a first circumferential direction with respect to the replacement siding panel.

20 Claims, 9 Drawing Sheets

(56) References Cited

U.S. PATENT DOCUMENTS

| | | | | |
|---|---|---|---|---|
| 6,070,919 | A * | 6/2000 | Finkelstein | E05B 65/0817 292/241 |
| 6,079,754 | A * | 6/2000 | Alexy | E04B 1/6183 292/202 |
| 6,299,224 | B1 * | 10/2001 | Finkelstein | E04B 1/6183 292/241 |
| 9,803,403 | B2 * | 10/2017 | Finkelstein | F16B 5/0004 |
| 10,866,012 | B2 * | 12/2020 | Kvasnicka | E04D 13/17 |
| 11,479,980 | B1 * | 10/2022 | Gregory | E04F 13/0803 |
| 11,486,132 | B2 * | 11/2022 | Gottschling | E04B 1/6116 |
| 2005/0262792 | A1 * | 12/2005 | Walda | E04F 21/1855 52/547 |
| 2005/0262797 | A1 * | 12/2005 | Davis | E04F 13/0864 52/712 |
| 2007/0256385 | A1 * | 11/2007 | Walda | E04F 21/1855 52/545 |
| 2009/0107084 | A1 * | 4/2009 | Hutchings | E04F 21/1855 52/749.1 |
| 2009/0211193 | A1 * | 8/2009 | Raines | E04F 21/1855 52/544 |
| 2021/0332594 | A1 * | 10/2021 | Steffes | E04B 1/388 |

* cited by examiner

SIDING LOCK REPAIR CLIP AND METHOD OF INSTALLATION

CROSS-REFERENCE TO RELATED APPLICATIONS

This application claims the benefit of priority of U.S. Provisional Patent Application No. 63/015,301, filed Apr. 24, 2020, which is hereby incorporated herein by reference in its entirety.

BACKGROUND OF THE DISCLOSURE

1. Field of the Disclosure

The present disclosure relates generally to siding, for example, suitable for covering the exterior surface of a building. The present disclosure relates more particularly to a repair clip for locking a replacement siding panel to an existing upper siding panel secured to a support structure, such as an exterior sheathing or wall framing.

2. Technical Background

Building surface panels, such as siding, are visible elements that cover an underlying support structure. Siding panels are typically used in the construction of homes, businesses, and other buildings on exterior walls. The siding panels provide both an aesthetic element to cover functional layers of the underlying wall structure as well as protection from weather and other elements.

Most siding panels are installed on a support structure from bottom to top. The lower side of a panel includes a lock that is coupled to a corresponding lock at the top of a lower panel. The upper side of the panel is then attached directly to the support structure. The next row of siding panels is secured to the support structure in a similar fashion, where the lower side is locked to a neighboring panel and the upper side is attached directly to the support structure. Because of this installation sequence, when a panel is damaged, it cannot easily be individually replaced. After the damaged panel is removed and a gap in the siding exists, it is not possible to insert a new replacement panel. If the replacement panel is slid up under the upper neighboring panel and the upper lock of the replacement panel engages the bottom lock of the upper neighboring panel, the bottom lock of the replacement panel cannot reach the corresponding lock of the lower neighboring panel. Instead, all of the siding panels above the damaged panel must be removed and reinstalled with a replacement panel in place of the damaged panel in order to secure the locks. This process is slow and costly.

The present inventors have recognized that a system allowing for faster and easier installation of a replacement siding panel would be attractive to builders and repairmen.

SUMMARY OF THE DISCLOSURE

In one aspect, the present disclosure provides a siding repair clip comprising:

a hub configured to be secured to a replacement siding panel so as to be rotatable with respect to the replacement siding panel;

a leg extending from the hub in a first radial direction and configured to engage with a lip of a bottom lock of an upper siding panel;

a positioning member extending from the hub in a second radial direction and including a first detent configured to impede rotation of the hub with respect to the replacement siding panel; and a rotating member configured to rotate the siding repair clip about the hub in a first circumferential direction with respect to the replacement siding panel.

In another aspect, the disclosure provides a siding panel system comprising:

a support structure;

an upper siding panel attached to the support structure, the upper siding panel including a bottom lock having an upwardly extending lip;

a replacement siding panel attached to the support structure; and a siding repair clip according to the disclosure, wherein the hub of the siding repair clip is secured toward a top of the replacement siding panel, and wherein the leg of the siding repair clip is engaged with the lip of the bottom lock of the upper siding panel so as to hold the bottom lock of the upper siding panel against the replacement siding panel.

In another aspect, the disclosure provides a method of securing a replacement siding panel to an upper siding panel that is attached to a support structure using a siding repair clip according to the disclosure so as to form the system of the disclosure, the method comprising:

positioning the siding repair clip on the replacement siding panel in a primed position;

positioning the replacement siding panel behind an upper siding panel that is affixed to the support structure such that the siding repair clip is above the upwardly extending lip of the bottom lock of the upper siding panel;

affixing the replacement siding panel to the support structure;

rotating the siding repair clip from the primed position to a locked position in which the leg of the siding repair clip is engaged with the lip of the bottom lock of the upper siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional methods of replacing siding panels are slow and costly. The present inventors have determined that a system allowing for faster and easier installation of a replacement siding panel would be attractive to builders and repairmen.

Accordingly, one aspect of the disclosure is a siding repair clip. The siding repair clip includes a hub configured to be secured to a replacement siding panel so as to be rotatable with respect to the replacement siding panel. A leg extends from the hub in a first radial direction and is configured to engage with a lip of a bottom lock of an upper siding panel. A positioning member extends from the hub in a second direction and includes a first detent configured to impede rotation of the hub with respect to the replacement siding panel. The siding repair clip also includes a rotating member configured to rotate the siding repair clip about the hub in a first circumferential direction with respect to the replacement siding panel.

Figure 1:
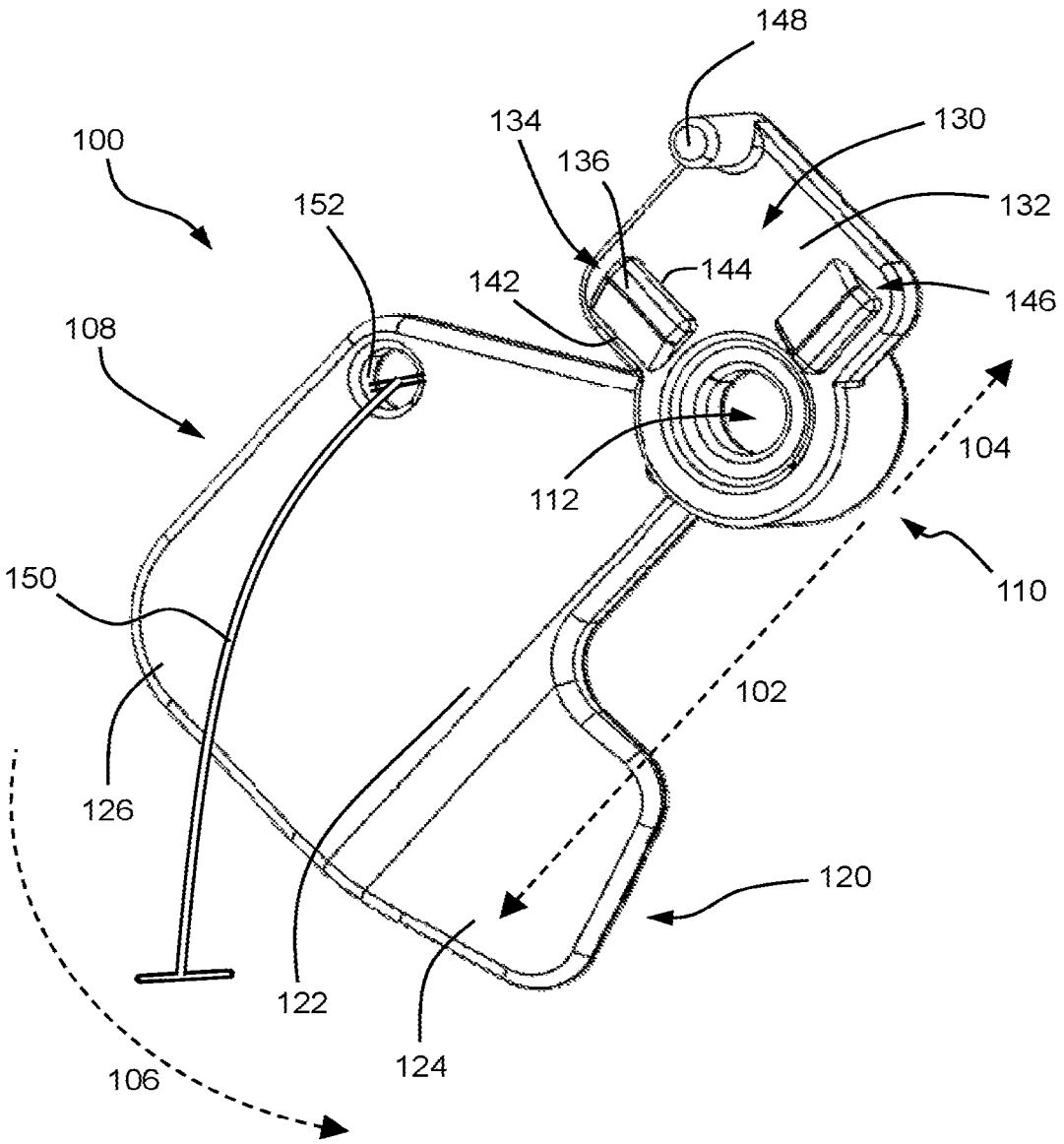
FIG. 1 is a schematic perspective rear view of a siding repair clip according to an embodiment of the disclosure.
Figure 3A:
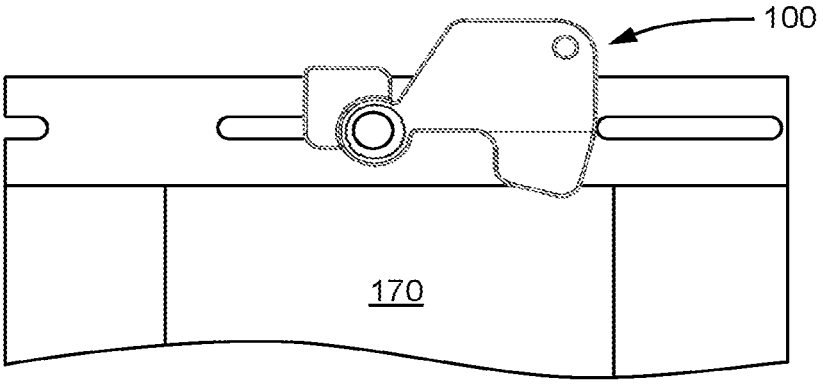
FIGS. 3A-3C illustrate the operation of the siding repair clip according to FIG. 1 connecting two siding panels according to an embodiment of the disclosure.
Figure 3B:
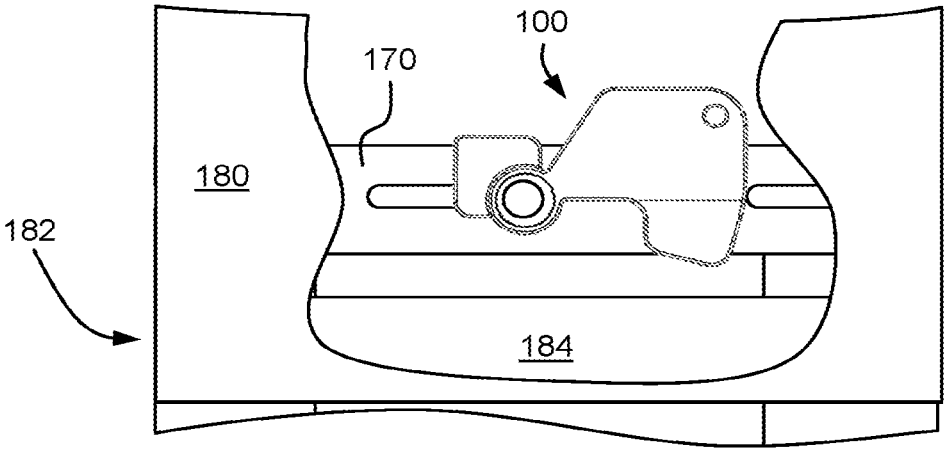
Figure 3C:
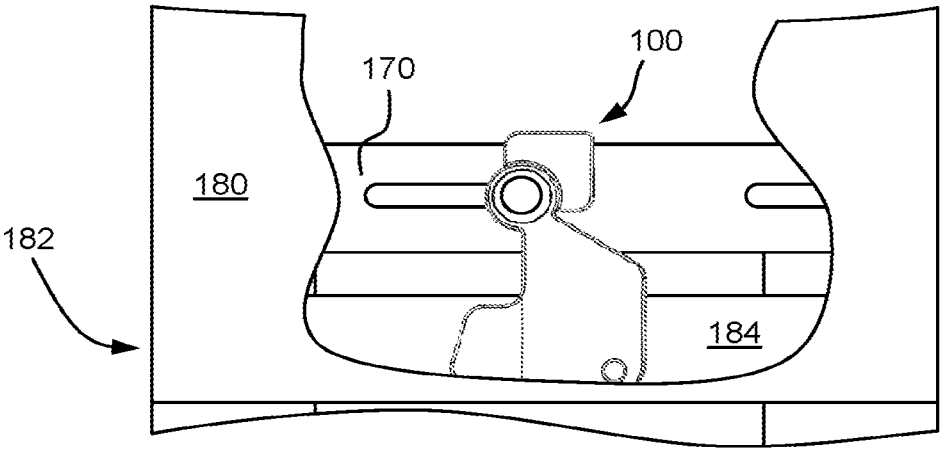

Such a siding repair clip is shown in perspective view in FIG. 1. Siding repair clip 100 includes a hub 110, a leg 120 extending from hub 110, a positioning member 130 also extending from hub 110, and a rotating member 150. Hub 110 is configured to be secured to a replacement siding panel and is secured in such a way that hub 110 is rotatable with respect to the replacement siding panel. Leg 120 extends from hub 110 in a first radial direction 102. Leg 120 is configured to engage with a lip of a bottom lock of an upper siding panel (as shown in FIGS. 3A-3C).

Positioning member 130 extends from hub 110 in a second radial direction 104 and includes a first detent 134. When hub 110 is secured to the replacement siding panel, first detent 134 is configured to engage the replacement siding panel and impede rotation of hub 110 with respect to the replacement siding panel. Further, rotating member 150 is configured to rotate siding repair clip 100 about hub 110 in a first circumferential direction 106 with respect to the replacement siding panel that hub 110 is secured to. While the leg 120 and positioning member 130 in siding repair clip 100 extend in substantially opposite radial directions 102, 104 from hub 110, in other embodiments, the first radial direction in which the leg extends and the second radial direction in which the positioning member extends are at another angle from one another. For example, in some embodiments the first radial direction is at a right angle from the second radial direction.

The directions relating to the siding repair clip described herein are made with reference to the hub of the siding repair clip. Accordingly, a radial direction relates to a direction that extends radially outward from the hub, an axial direction relates to the direction of the axis of the hub, and a circumferential direction relates to the direction of rotation of the siding repair clip about the hub.

As explained above, when two siding panels are positioned on a support structure with a gap for a new siding panel between them, it is not possible to insert a new replacement siding panel between the two existing siding panels if the existing siding panels have already been attached to the support structure. In a typical installation, siding panels are installed in rows starting from the bottom of a support structure. A first siding panel, or a portion of a first siding panel, is affixed at the bottom of the support structure using a fastening strip. With the first siding panel in place, a bottom lock of a second siding panel is hooked over a top lock of the first siding panel. The fastening strip at the top of the second siding panel is then placed against the support structure at the proper height and affixed to the support structure. Additional siding panels may then be attached above the previously installed panels in a similar fashion. Thus, as each row of siding panels is installed, it only needs to engage one lock, i.e., the top lock of the previously installed panel. However, when a siding panel in the middle of a wall of siding panels needs to be replaced with a replacement siding panel, both the top and bottom locks of the replacement siding panel need to engage the locks of the respective neighboring siding panels. However, the engaging portions of the locks of the respective neighboring siding panels form an obstruction when an attempt is made to secure both the top and bottom locks of the replacement siding panel. For instance, if the replacement siding panel is first placed behind the upper siding panel and attached to the support structure, the lip of the bottom lock of the lower replacement siding panel will not be able to "reach" over the top lock of the bottom siding panel.

The siding repair clip of the disclosure is configured to attach to the top of a replacement siding panel and substitute for the top lock of the replacement siding panel. In particular, the leg of the repair clip is configured to engage with the lip of the bottom lock of the upper siding panel in a similar manner as the top lock of a standard siding panel. Unlike the standard top lock of a siding panel, the position of the siding repair clip leg is adjustable by rotating the repair clip. This way, the bottom lock of the replacement panel can be "locked" into the top lock of a lower siding panel and then, once in position, the siding repair clip can engage the bottom lock of the upper siding panel. Accordingly, the leg of the repair clip can hold in a primed position that does not obstruct the positioning of the replacement siding panel during installation. Once the replacement siding panel is in place, the siding repair clip can be rotated into place using a rotating member so that the foot engages the lip of the bottom lock of the upper siding panel and secures the upper siding panel and replacement siding panel together, as described in more detail below.

FIGS. 3A-3C illustrate an example of the operation of a siding repair clip according to the disclosure, as explained in more detail below. Siding repair clip 100 is initially secured toward the top of replacement siding panel 170, as shown in FIG. 3A. The upper side of replacement siding panel 170 is then placed behind the lower side of an upper siding panel 180, as shown in FIG. 3B. Because the siding repair clip 100 extends forward from the front face of replacement siding panel 170, the siding repair clip 100 is behind the front face of the upper siding panel 180 but in front of the lip 184 of the bottom lock 182 of upper siding panel 180. Accordingly, when siding repair clip 100 is rotated into the locked position, as show in FIG. 3C, the leg 120 of siding repair clip 100 is positioned in front of the lip 184 of the bottom lock 182 of upper siding panel 180 such that the siding repair clip 100 secures the replacement siding panel 170 to the upper siding panel 180.

Figure 7:
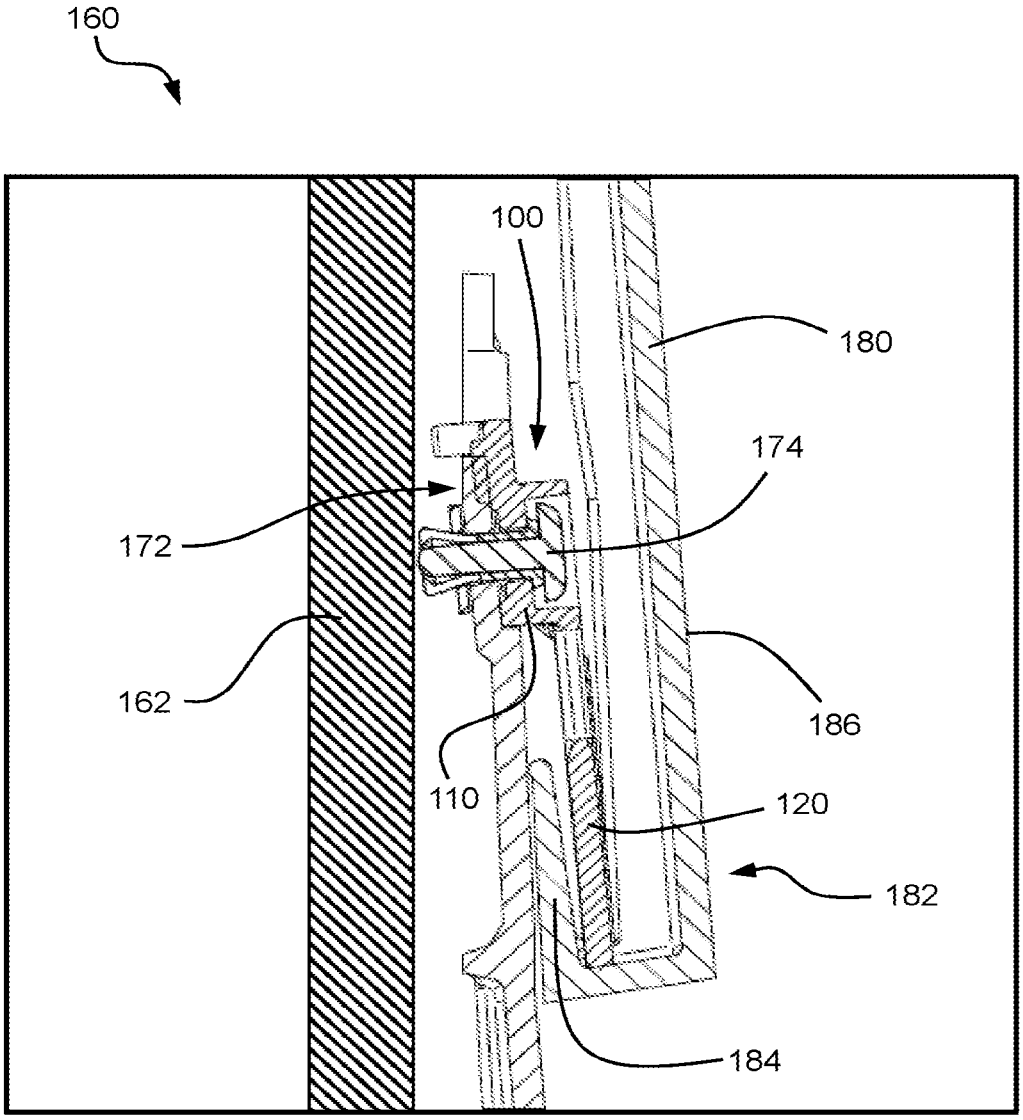
FIG. 7 is a schematic side view of a portion of the siding panel system of FIG. 6.

A side view of the interaction between the siding repair clip 100, the replacement siding panel 170 and the upper siding panel 180 when the siding repair clip 100 is in the locked position is shown in FIG. 7 with respect to a system of the disclosure, as described in more detail below. As shown, siding repair clip 100 is secured to replacement siding panel 170 using a rivet 174. Further, leg 120 of siding repair clip 100 is positioned between the lip 184 of bottom lock 182 and the front surface 186 of upper siding panel 180. Accordingly, in view of the attachment of siding repair clip 100 to the replacement siding panel 170 using the rivet 174, and the position of the leg 120 within lock 182, the two siding panels 170, 180 are secured to one another by way of the siding repair clip 100.

In certain embodiments of the siding repair clip as otherwise described herein, the hub includes a hole for receiving a fastener that is configured to secure the hub to the replacement siding panel. For example, hub 110 of siding repair clip 100 includes hole 112, which is configured to receive a rivet, bolt, or other mechanical fastener for securing the siding repair clip to the replacement siding panel. Hole 112 of hub 110 is a circular hole. However, in other embodiments, the hole is a shape other than circular, such as a square, rectangular or other polygonal hole. In other embodiments, the hole is oblong, or in the form of a slot. In other embodiments, the siding repair clip includes a fastener that is integrally formed with the body of the repair clip, rather than having a hole to receive a fastener. For example, in some embodiments a snap fastener is integrated in the rear side of the hub, where the snap fastener is configured to engage with the aperture in the fastening strip of the replacement siding panel.

In certain embodiments of the siding repair clip as otherwise described herein, the siding repair clip further includes a fastener configured to extend through the aperture and secure the hub to the replacement siding panel. In other embodiments, the repair clip does not include a fastener, and instead a fastener is supplied by the installer.

In certain embodiments of the siding repair clip as otherwise described herein, the first detent includes a protrusion that extends in an axial direction of the siding repair clip. For example, as shown in FIG. 1, first detent 134 of positioning member 130 includes protrusion 136 that extends in an axial direction with respect to hub 110. Specifically, positioning member 130 includes a plate 132 that has a protrusion 136 extending outward from the plate 132 in the axial direction. Accordingly, when the siding repair clip 100 is attached to a siding panel, the protrusion 136 will extend toward the siding panel so as to engage a portion of the siding panel and impede rotation of the siding repair clip 100, as explained in more detail below.

Figure 4:
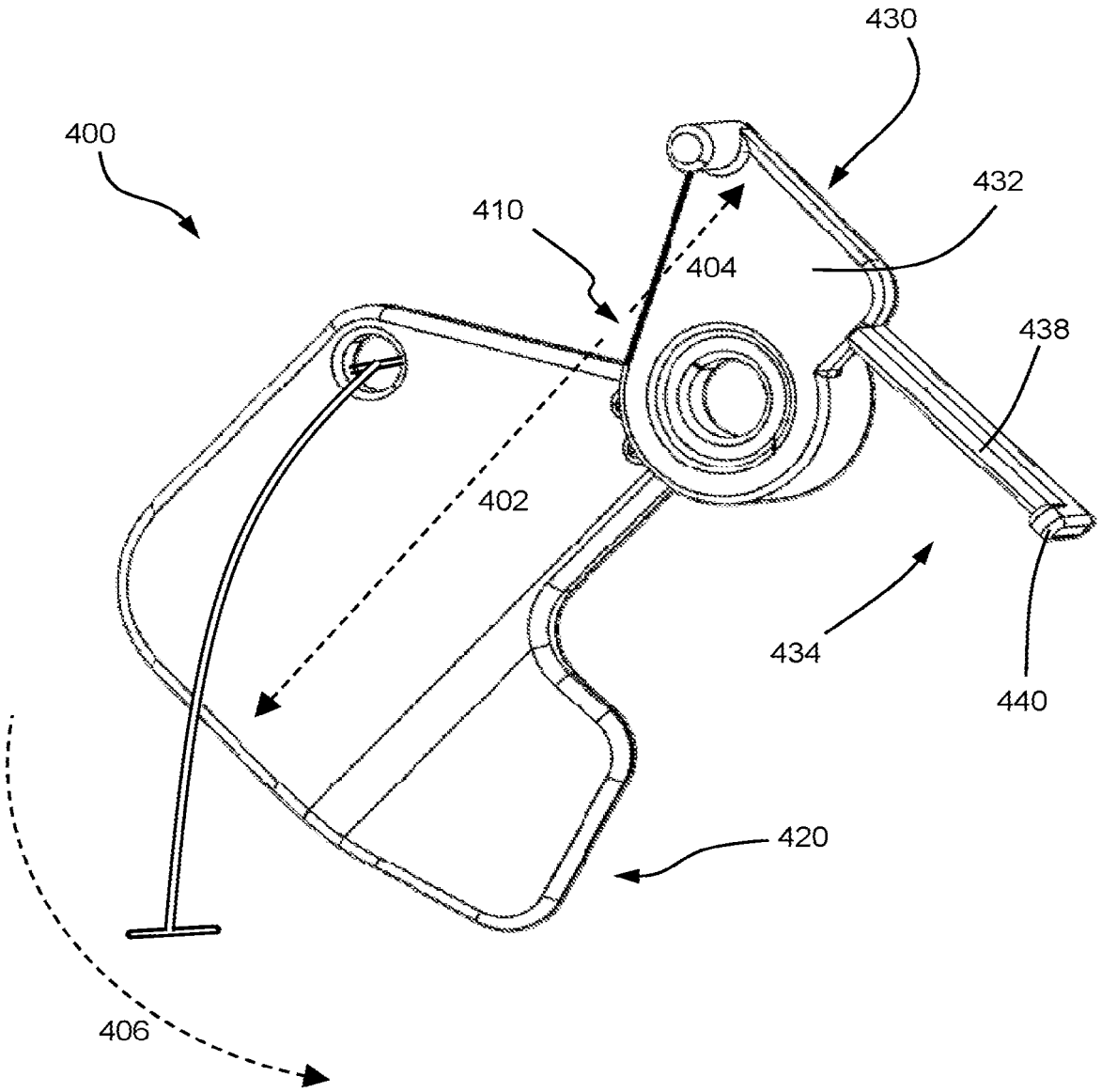
FIG. 4 is a schematic perspective rear view of a siding repair clip according to another embodiment of the disclosure.

In certain embodiments of the siding repair clip as otherwise described herein, the first detent includes an arm that extends in a radial direction and a finger that extends from the arm in an axial direction. For example, such a siding repair clip is shown in FIG. 4. Siding repair clip 400 includes a hub 410, a leg 420 extending from hub 410 and a positioning member 430 also extending from hub 410. Hub 410 is configured to be secured to a replacement siding panel so as to be rotatable with respect to the replacement siding panel. Leg 420 extends from hub 410 in a first radial direction 402 and is configured to engage with a lip of a bottom lock of an upper siding panel. Likewise, positioning member 430 extends from hub 410 in a second radial direction 404 and includes a first detent 434 configured to impede rotation of hub 410 about a first circumferential direction 406 with respect to the replacement siding panel. First detent 434 of positioning member 430 includes an arm 438 and a finger 440 positioned on arm 438. The finger 440 extends in an axial direction so as to engage a replacement siding panel when siding repair clip 400 is attached thereto, and to impede rotation of the siding repair clip 400 by way of the engagement of finger 440 with the replacement siding panel. While positioning member 430 includes a plate 432 extending outward from hub 410, and arm 438 extends from plate 432, in other embodiments, the arm of the detent extends directly from the hub.

In certain embodiments of the siding repair clip as otherwise described herein, the first detent is configured to secure the siding repair clip in a locked position. For example, first detent 134 of positioning member 130 of siding repair clip 100 is configured to secure siding repair clip 100 in the locked position after siding repair clip 100 has been rotated from the primed position. Specifically, as siding repair clip 100 is rotated from the primed position to the locked position, first detent 134 rotates downward into further engagement with the replacement siding panel. The engagement between first detent 134 and the replacement siding panel impedes the further rotation of the siding repair clip 100. In some embodiments, the first detent is configured to rotate into a recess in the replacement siding panel. The recess then forms a catch for the first detent and holds the siding repair clip in the locked position. For example, first detent 134 of positioning member 130 is configured such that it may catch within a recess in the replacement siding panel when the siding repair clip is rotated into the locked position. For example, the protrusion 136 of first detent 134 may catch within a nail slot in the fastening hem of the replacement siding panel. Likewise, finger 440 at the end of arm 438 of first detent 434 of siding repair clip 400, as shown in FIG. 4, may be configured to engage within a recess in the replacement siding panel when siding repair clip 400 is rotated into the locked position. Accordingly, the finger 440 of first detent 434 can impede further rotation of siding repair clip 400 once it catches in the recess. In other embodiments, the first detent is configured to rotate into frictional engagement with a surface of the replacement siding panel without securing in a recess. The frictional engagement alone can hold the siding repair clip in the locked position.

In certain embodiments of the siding repair clip as otherwise described herein, the first detent includes a ramped edge pointing toward the first circumferential direction and a sharp edge opposite the ramped edge. For example, first detent 134 of positioning member 130 includes a protrusion 136 that has a ramped edge 142 pointing toward the first circumferential direction 106 and a sharp edge 144 opposite the ramped edge 142. In other words, the height of protrusion 136 tapers gradually on the side of protrusion 136 in the first circumferential direction 106, i.e., the ramped edge 142, and drops off sharply on the opposing side, i.e., the sharp edge 144. As the siding repair clip 100 is rotated about the hub 110 relative to the replacement siding panel, the ramped edge 142 leads and the sharp edge 144 follows. Thus, the ramped edge 142 of the first detent 134 allows for the siding repair clip 100 to rotate about the hub 110 with less resistance, as the ramped edge 142 aids in pushing the first detent 134 over any obstructions. However, once the sharp edge 144 of the first detent 134 meets the recess and the protrusion 136 is inserted into the recess, the protrusion 136 impedes the further rotation of the hub 110 with respect to the replacement siding panel. In some embodiments, the ramped edge is formed as an angled plane, such as ramped edge 142, while in other embodiments the ramped edge is curved. For example, in some embodiments the first detent is formed by a spherical or cylindrical section. For example, in some embodiments the first detent is formed as a quarter of a sphere extending outward from a surface of the positioning member, where the curved face of the spherical section provides the ramped edge and a flat face of the spherical section provides the sharp edge. In other embodiments, the first detent does not include a ramped edge and a sharp edge. For example, in some embodiments, the first detent is symmetrical, and has similar edges on both sides. For example, in some embodiments, the first detent has a slightly curved edge on both sides. In other embodiments, the first detent has a ramped edge on both sides. For example, in some embodiments the first detent is formed as hemisphere or half a cylinder.

In certain embodiments of the siding repair clip as otherwise described herein, the positioning member includes a second detent configured to maintain the siding repair clip in a primed position. For example, positioning member 130 of siding repair clip 100, as shown in FIG. 1, includes a second detent 146 that is configured to maintain the primed position. Thus, positioning member 130 of siding repair clip 100 includes both first detent 134, which is configured to retain siding repair clip 100 in the locked position after it has rotated, and second detent 146, which is configured to maintain the siding repair clip in the primed position before it is rotated. In some embodiments, the second detent is configured to engage a recess in the replacement siding panel so as to retain the siding repair clip in the primed position. For example, second detent 146 is situated on positioning member 130 such that it is configured to fit into a recess in the replacement siding panel to prevent siding repair clip 100 from moving out of the primed position. In particular, second detent 146 is configured to fit into a nail slot in the replacement siding panel. In some embodiments, the first detent is configured to lock into the same recess on the replacement siding panel that the second detent was in. In other embodiments, the first detent and the second detent engage with different recesses in the replacement siding panel.

In other embodiments, the second detent utilizes friction against the replacement siding panel to inhibit rotation of the siding repair clip instead of engaging with a recess. For example, in some embodiments, friction between the second detent and the replacement siding panel prevents the siding repair clip from moving out of the primed position, but an intentional force on the siding repair clip, such as a rotational force provided by a person, can overcome the friction to move the siding repair clip from the primed position to the locked position. Similar to the first detent, in some embodiments, the second detent has a ramped edge and a sharp edge. In other embodiments, the second detent has other shapes.

Figure 5:
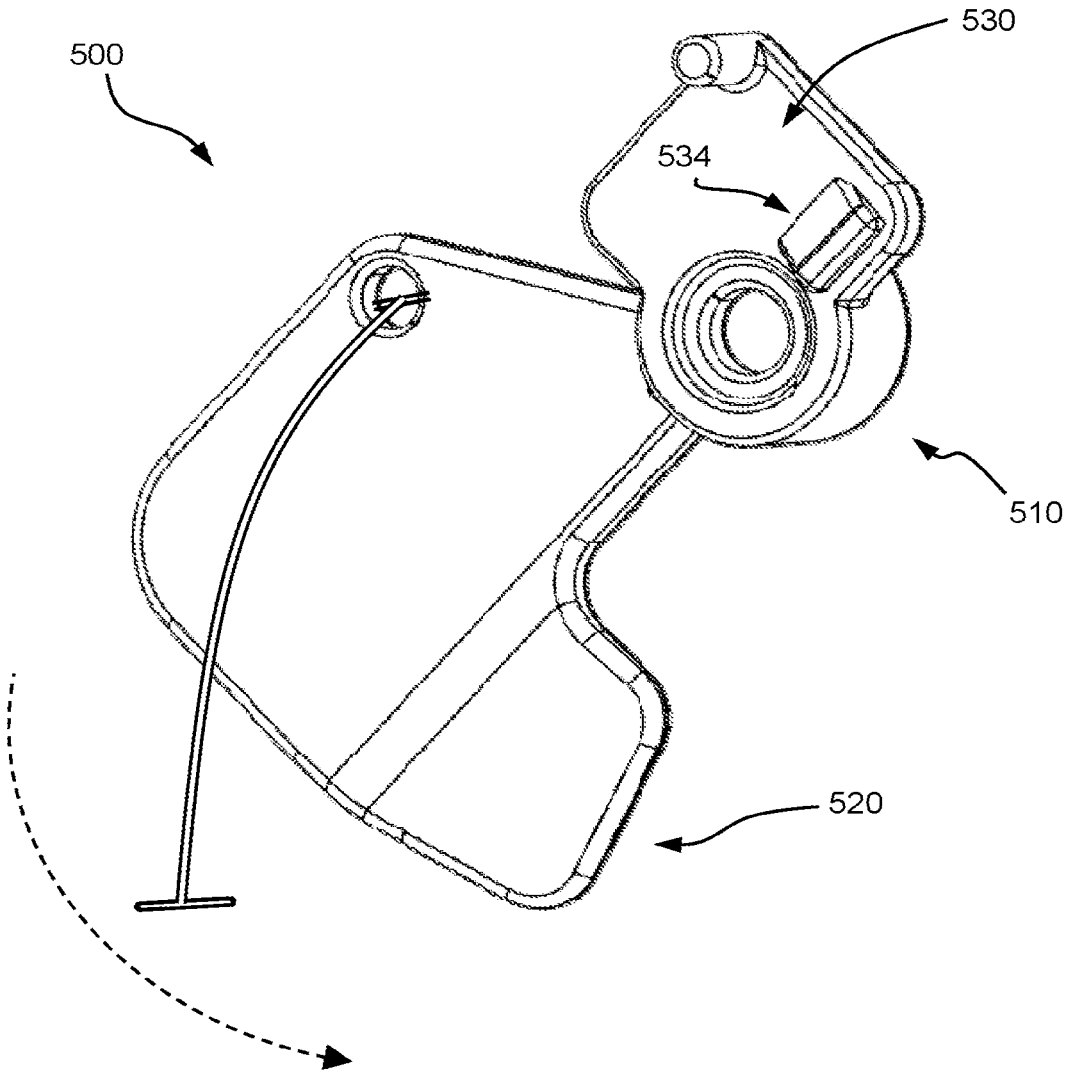
FIG. 5 is a schematic perspective rear view of a siding repair clip according to another embodiment of the disclosure.

While, siding repair clip 100 includes both a first detent and a second detent, in other embodiments, the siding repair clip includes only a first detent. Thus, in some embodiments, the siding repair clip includes a first detent configured to retain the siding repair clip in the locked position without a second detent that is configured to retain the siding repair clip in the primed position. On the other hand, in certain embodiments of the siding repair clip as otherwise described herein, the first detent is configured to maintain the siding repair clip in a primed position. Such a siding repair clip is shown in FIG. 5. Siding repair clip 500 includes a hub 510 configured to attach to a replacement siding panel. Siding repair clip 500 also includes a leg 520 extending from hub 510 in a first radial direction and positioning member 530 extending from hub 510 in a substantially opposite direction. Leg 520 is configured to engage with a lock of an upper siding panel as siding repair clip 500 is rotated about hub 510. Further positioning member 530 of siding repair clip 500 includes a first detent 534 that is configured to maintain siding repair clip 500 in a primed position until it is rotated by the installer.

In certain embodiments of the siding repair clip as otherwise described herein, the siding repair clip further includes a stopper configured to prevent further rotation of the siding repair clip in the first circumferential direction when the siding repair clip is in the locked position. For example, siding repair clip 100 includes a stopper 148 that is configured to provide a limit on the extent to which siding repair clip 100 can rotate in the first circumferential direction 106 when it is secured to a replacement siding panel. In particular, stopper 148 is in the form of a post that extends in the axial direction and is configured to abut the replacement siding panel when it reaches the rotational limit so as to prevent any further rotation. In siding repair clip 100, stopper 148 is formed as cylindrical post, but in other embodiments, the stopper is a different shape such as a cube, a pyramid, or a half sphere. Further, while stopper 148 of siding repair clip 100 is configured to abut the replacement siding panel, in other embodiments, the stopper extends in the opposite axial direction so as to abut a portion of another siding panel, such as the upper siding panel.

In certain embodiments of the siding repair clip as otherwise described herein, the stopper is disposed on the positioning member. For example, stopper 148 of siding repair clip 100 is located on the corner of positioning member 130 in a location where the stopper 148 will abut an edge of the replacement siding panel when the siding repair clip 100 has reached the locked position. In other embodiments, the stopper is positioned on a portion of the siding repair clip other than the positioning member such as the hub, or the leg. In further embodiments, the stopper is disposed on an arm.

In certain embodiments of the siding repair clip as otherwise described herein, the leg includes a stem that extends radially outward from the hub and a foot that extends from the stem in the first circumferential direction. For example, as shown in FIG. 1, leg 120 of siding repair clip 100 includes stem 122. Stem 122 extends radially outward from hub 110 and includes foot 124 that extends from stem 122 in the first circumferential direction 106. Foot 124 is disposed at the radial outer end of stem 122. In some embodiments, the foot is disposed at a radial midpoint on the stem. Foot 124 provides the leading edge of leg 120 as siding repair clip 100 is rotated such that leg 120 engages the bottom lock of an upper siding panel. Foot 124 extends over only a portion of the radial length of leg 120, and thus allows the initial engagement between siding repair clip 100 and the bottom lock of the upper siding panel to be reduced in size. The smaller leading edge of foot 124 reduces the likelihood that a portion of the siding repair clip 100 might get caught on a portion of the upper siding panel. While foot 124 of siding repair clip 100 is located at the radially outer end of leg 120, in other embodiments the foot is located in another position. For example, in some embodiments, the foot is disposed in the middle of the leg. Further, in some embodiments, the foot includes specific features to promote a smooth engagement of siding repair clip with the bottom lock of the upper siding panel as the siding repair clip is rotated.

Figure 2:
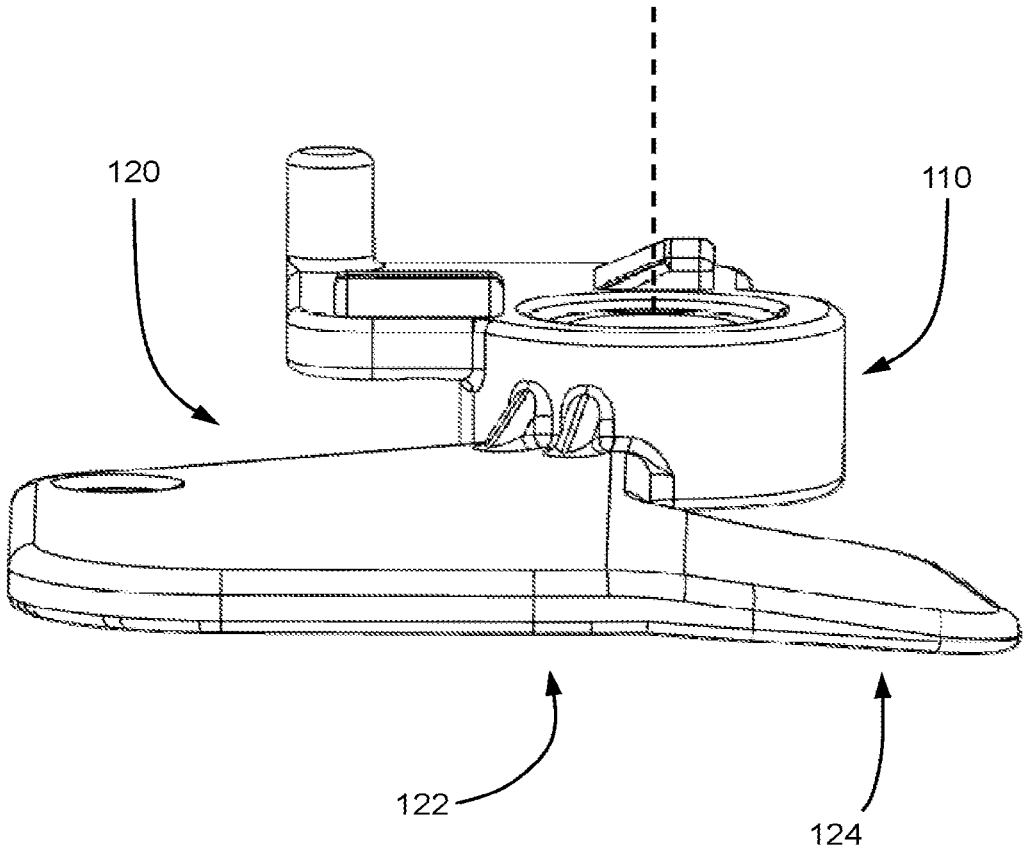
FIG. 2 is a schematic perspective bottom view of the siding repair clip according to FIG. 1.

For example, in some embodiments, the foot is angled so as to project in an axial direction. For example, as shown in FIG. 2, foot 124 is angled so that the extension of foot 124 from stem 122, which is primarily in the first circumferential direction 106, also projects slightly in the axial direction. The angle of the foot in the axial direction helps prevent the foot 124 from being obstructed by the edge of the lip of the bottom lock of the upper siding panel as the siding repair clip 100 is rotated toward the locked position. Instead, the angled foot 124 will slide in front of the edge of the lip and guide the foot 124 into the locked position (as shown in FIG. 7). In other embodiments, the foot is not angled out in the axial direction. For example, in some embodiments, the foot has a rounded leading edge to help promote the proper engagement of the siding repair clip with the bottom lock of the upper siding panel. Further, in some embodiments, the foot is simply positioned appropriately to avoid contact with the bottom lock of the upper siding panel. Further still, in some embodiments, the leg of the siding repair clip does not include a foot.

In certain embodiments of the siding repair clip as otherwise described herein, the hub, leg, and positioning member form a body of the siding repair clip. In some embodiments, the body is integrally formed in a single piece. The term integrally formed, as used herein, refers to a construction that is formed in a single piece. For example, in some embodiments, the siding repair clip includes an integrally formed body in a single piece that includes each of the hub, the leg, and the positioning member. For example, as shown in FIG. 1, siding repair clip 100 has an integrally formed body 108 that includes hub 110, leg 120 and positioning member 130. In other embodiments, the body is formed from two or more pieces that are bonded, welded, or fastened together.

In certain embodiments of the siding repair clip as otherwise described herein, the rotating is coupled to the body. For example, rotating member 150 is a separate piece from body 108 that is coupled to body 108. In other embodiments, the rotating member is integrally formed with the body.

In certain embodiments of the siding repair clip as otherwise described herein, the body includes an aperture and the rotating member is coupled to the aperture. For example, body 108 of siding repair clip 100 includes aperture 152 and rotating member 150 passes through aperture 152 so as to be secured to the body 108 of siding repair clip 100, as shown in FIG. 1. In other embodiments, the rotating member is tied through the aperture around the body. Likewise, in some embodiments, the rotating member is secured around a portion of the body without the use of an aperture. For example, in some embodiments, the rotating member is looped around a narrow section on the body. Further still, in other embodiments, the rotating member is secured to the body of the siding using a fastener.

In certain embodiments of the siding repair clip as otherwise described herein, the rotating member includes a tension line. For example, rotating member 150 is an elongate pull tab that forms a tension line extending from the body of the siding repair clip 100. As rotating member 150 is pulled by a user, tension on the rotating member 150 is transferred to a rotational force on the body 108 of siding repair clip 100 and causes the siding repair clip 100 to rotate into the locked position. In other embodiments, the rotating member is a cord or a string. Further, in other embodiments, the rotating member is provided by a tool that is configured to rotate the siding repair clip. For example, in some embodiments, the rotating member is a hex key that engages with the aperture in the body and projects radially outward to act as a handle.

In certain embodiments of the siding repair clip as otherwise described herein, the rotating member is removable from the body. For example, in some embodiments the rotation of the siding repair clip into the locked position moves the rotating member to a location that is in front of the siding panels and is viewable. Accordingly, in such embodiments, removal of the rotating member prevents the rotating member from interrupting the aesthetic of the siding panels. For example, rotating member 150 in siding repair clip 100 is a pull tab that may be cut or torn from the body 108 of siding repair clip 100. In other embodiments, for example where the rotating member is a hex key, or other tool, the tool is removable from the body of the repair clip by pulling the tool out of an aperture or otherwise disengaging the tool from the body. Further, in other embodiments, the rotating member is integrally formed with the body through a narrow bridge of material that is configured to be cut or torn to remove the rotating member from the remainder of the body of the siding repair clip. On the other hand, in other embodiments, the rotating member is configured to be retained with the remainder of the siding repair clip after the siding repair clip is rotated into the locked position.

In certain embodiments of the siding repair clip as otherwise described herein, the leg includes a flange that extends in the second circumferential direction, and the rotating member is coupled to the flange of the leg. The flange moves the point of connection between the rotating member and the body of the siding repair clip radially outward from the hub to increase the torque that is provided by pulling on the rotating member. For example, leg 120 of siding repair clip 100 includes flange 126 that extends in a second circumferential direction opposite first circumferential direction 106. Rotating member 150 is coupled to leg 120 at the outer end of flange 126 to provide torque for rotating the siding repair clip 100. In other embodiments, the rotating member is connected to the flange at a higher position when the siding repair clip is in the locked position. As a result of the connection between the rotating member 150 and the body 108 of siding repair clip 100 being located within flange 126, when siding repair clip 100 is in the primed position, the rotating member 150 is connected to the body 108 of siding repair clip 100 above the horizontal axis of hub 110 and radially outward from hub 110. This location increases the amount of torque that is exerted on the siding repair clip as the rotating member 150 is pulled in a downward direction. Moreover, the location of this connection continues to provide torque in the first circumferential direction even as siding repair clip reaches the locked position. In some embodiments, the rotating member is connected to the flange at a radially inner position, which helps avoid interference between the rotating member and the bottom lock of the upper siding panel as the siding repair clip is rotated. In other embodiments, the rotating member is connected to the flange at a radially outer position. Further, in some embodiments, the rotating member extends directly from the hub.

In certain embodiments of the siding repair clip as otherwise described herein, the body is formed of a polymer material, such as polycarbonate, polyamide, acrylonitrile butadiene styrene (ABS), polyvinyl chloride (PVC), acrylonitrile styrene acrylate (ASA), or polypropylene. In other embodiments, the body is formed of a metal material, such as aluminum, tin, steel or another metal. Further, in some embodiments, the body is formed of more than one material. For example, in some embodiments, the hub is formed of one material, while the positioning member is formed of another material. Other combinations of materials is also possible.

In another aspect, the disclosure provides a siding panel system including a support structure, an upper siding panel and a replacement siding panel. The upper siding panel is attached to the support structure and includes a bottom lock having an upwardly extending lip. The replacement siding panel is also attached to the support structure. Further, a siding repair clip according to the disclosure connects the upper and replacement siding panels. In particular, the hub of the siding repair clip is secured toward a top of the replacement siding panel. Further, the leg of the siding repair clip is engaged with the lip of the bottom lock of the upper siding panel so as to hold the bottom lock of the upper siding panel against the replacement siding panel.

Figure 6:
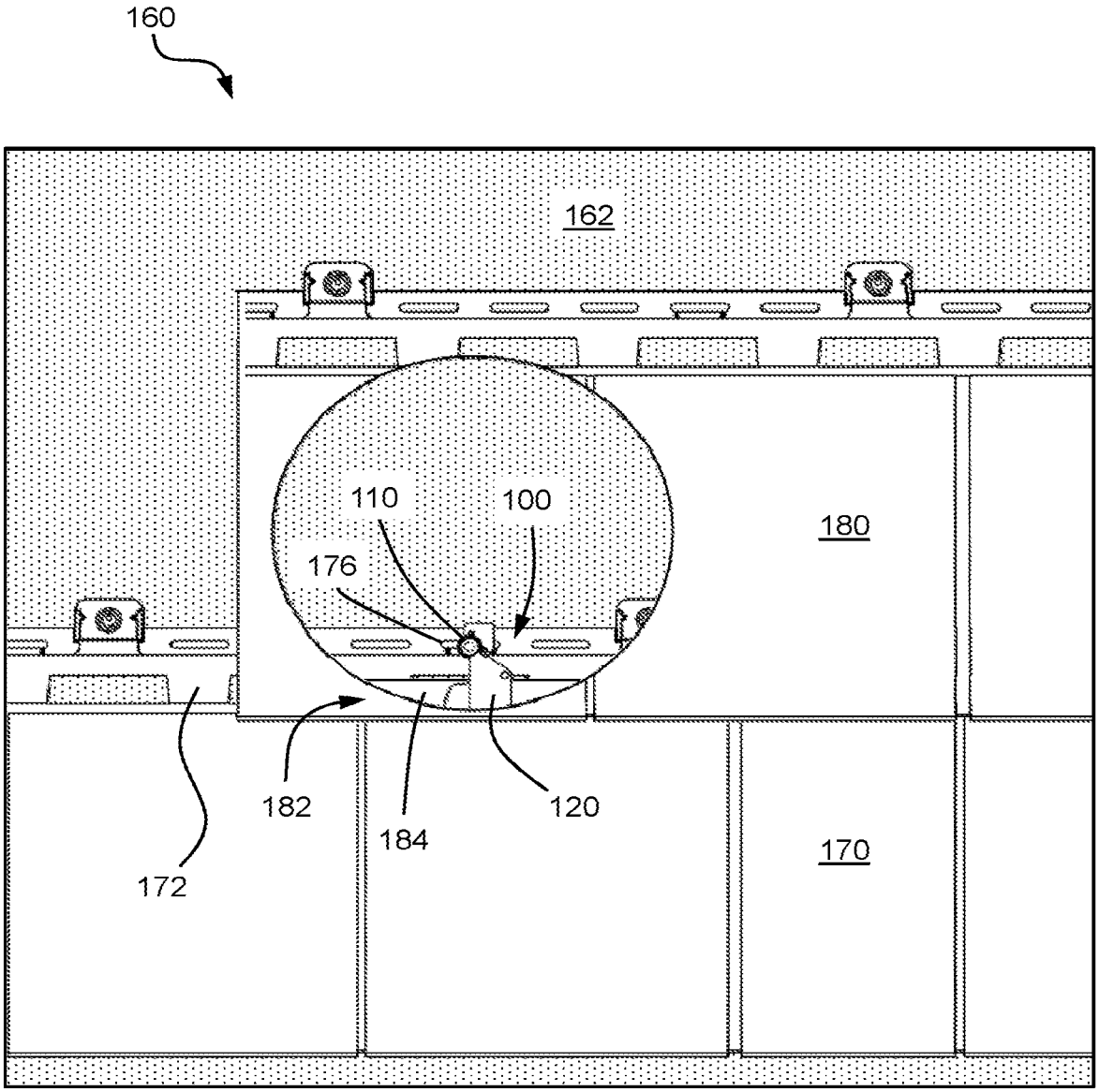
FIG. 6 is a schematic front view of a portion of a siding panel system using the siding repair clip of FIG. 1 according to an embodiment of the disclosure.

A section of such a siding panel system is shown in a front view in FIG. 6. Siding panel system 160 includes a support structure 162, an upper siding panel 180 and a replacement siding panel 170. A circular section of upper siding panel 180 is removed to show the connection of the siding repair clip 100. Upper siding panel 180 is attached to support structure 162 and includes a bottom lock 182 having an upwardly extending lip 184. Replacement siding panel 170 is also attached to support structure 162. Further, siding panel system 160 also includes siding repair clip 100, which connects upper siding panel 180 and replacement siding panel 170. In particular, hub 110 of siding repair clip 100 is secured toward the top of replacement siding panel 170. Further, leg 120 of siding repair clip 100 is engaged with lip 184 of bottom lock 182 of upper siding panel 180 so as to hold bottom lock 182 of upper siding panel 180 against replacement siding panel 170.

The terms upper and lower in regards to the upper siding panel and replacement siding panel are used herein with respect to a typical siding panel installation, but are not intended to limit the orientation of the siding system. In a typical installation, siding panels are installed in horizontal rows, such that siding panels are disposed above and below one another, and the siding panels are attached to the support structure at the top. However, the terms upper and lower should not be interpreted to limit the orientation of the panels with respect to gravity. In some embodiments, the siding panels are installed to extend vertically, and in other embodiments the siding panels are installed diagonally.

In certain embodiments of the siding panel system as otherwise described herein, the hub of the repair clip is secured to a fastening strip of the replacement siding panel. For example, the hub 110 of siding repair clip 100 is attached to fastening strip 172 of replacement siding panel 170. In other embodiments, the hub is not secured to a fastening strip of the replacement siding panel. For example, in some embodiments, the hub of the siding repair clip is attached to the body of the siding.

In certain embodiments of the siding panel system as otherwise described herein, the hub of the siding repair clip is secured to the replacement siding panel using a fastener that passes through an aperture in the replacement siding panel. For example, siding repair clip 100 of siding panel system 160 includes a mechanical fastener 174 in the form of a rivet that passes through an aperture 176 in the fastening strip 172 of replacement siding panel 170. The side view of FIG. 7 shows the use of rivet 174 to secure siding repair clip 100 to replacement siding panel 170 more clearly. In other embodiments the fastener is another type of fastener. For example, in some embodiments the fastener is a snap-fit connector. Further, in other embodiments, the fastener is a bolt. Moreover, while aperture 176 of fastening strip 172 is in the form of a slot, in other embodiments the aperture has another shape, such as a round or polygonal hole.

In certain embodiments of the siding panel system as otherwise described herein, the lip of the bottom lock of the upper siding panel is disposed behind the leg of the siding repair clip. For example, as shown in FIG. 6, lip 184 of bottom lock 182 of upper siding panel 180 is positioned behind the leg 120 of siding repair clip 100. Accordingly, as shown in FIG. 7, leg 120 of siding repair clip 100 is positioned between the front surface 186 of upper siding panel 180 and the lip 184. Moreover, because siding repair clip 100 is also attached to replacement siding panel 170, the position of leg 120 in front of lip 184 of upper siding panel 180 allows siding repair clip 100 to hold the lower end of upper siding panel 180 securely against the upper end of replacement siding panel 170. As a result, siding repair clip 100 serves the same function as a standard top lock of a siding panel, which would likewise be positioned between the front surface 186 and lip 184 of upper siding panel 180.

In certain embodiments of the siding panel system as otherwise described herein, the siding repair clip is one of a plurality of siding repair clips that hold the bottom lock of the upper siding panel against the replacement siding panel. For example, in various embodiments, a plurality of siding repair clips are positioned along the fastening strip of the replacement siding panel so as to secure the replacement siding panel in place along its entire length. For example, in some embodiments, the replacement siding panel is secured with a range of 3 to 20 siding repair clips, e.g., 4 to 15, e.g., 6 to 10. In some embodiments the plurality of siding repair clips are spaced a predetermined distance apart. For example, in some embodiments, each the siding repair clips are spaced in a range of 6 inches to 3 feet apart. In other embodiments, the siding repair clips are attached to the replacement siding panel at predetermined locations on the replacement siding panel.

Embodiments of the siding panels of the siding panel system may be formed from various different materials, and may be constructed in a single piece or in layers of material. In certain embodiments of the siding panel system as otherwise described herein, each of the siding panels is formed of one or more of polypropylene, polyethylene, polyvinyl chloride (PVC), acrylonitrile styrene acrylate (ASA), polyurethane, polycarbonate, or acrylonitrile butadiene styrene (ABS). In other embodiments, the siding panels are formed of another material. For example, in some embodiments, the siding panels are formed of metal, such as aluminum, tin, steel, or another metal.

In certain embodiments of the siding panel system as otherwise described herein, the support structure is an exterior sheathing. As will be understood by those of ordinary skill in the art, such an exterior sheathing can include a rain protection layer, house wrap, and/or may include furring strips. In other embodiments, the support structure is another flat structural component of a construction wall.

In another aspect the disclosure provides a method of securing a replacement siding panel to an upper siding panel using a siding repair clip according to the disclosure so as to form a system according to the disclosure. The method includes positioning the siding repair clip on the replacement siding panel in a primed position. The method also includes positioning the replacement siding panel behind an upper siding panel that is affixed to the support structure such that the siding repair clip is above the upwardly extending lip of the bottom lock of the upper siding panel. The replacement siding panel is then affixed to the support structure. To couple the siding panels, the siding repair clip is rotated from the primed position to a locked position in which the leg of the siding repair clip is engaged with the lip of the bottom lock of the upper siding panel.

Such a method using siding repair clip 100 is briefly described above and shown in FIGS. 3A-3C. As shown in FIG. 3A, siding repair clip 100 is first secured toward the top of replacement siding panel 170, as shown in FIG. 3A. The upper side of replacement siding panel 170 is then placed behind the lower side of an upper siding panel 180, as shown in FIG. 3B. Because the siding repair clip 100 extends forward from the front face of replacement siding panel 170, the siding repair clip 100 is behind the front face of the upper siding panel 180 but in front of the lip 184 of the bottom lock 182 of upper siding panel 180. Accordingly, when siding repair clip 100 is rotated into the locked position, as show in FIG. 3C, the leg 120 of siding repair clip 100 is positioned in front of the lip 184 of the bottom lock 182 of upper siding panel 180 such that the siding repair clip 100 secures the replacement siding panel 170 to the upper siding panel 180. As explained in further detail below, the first detent impedes rotation of the siding repair clip.

Figure 8:
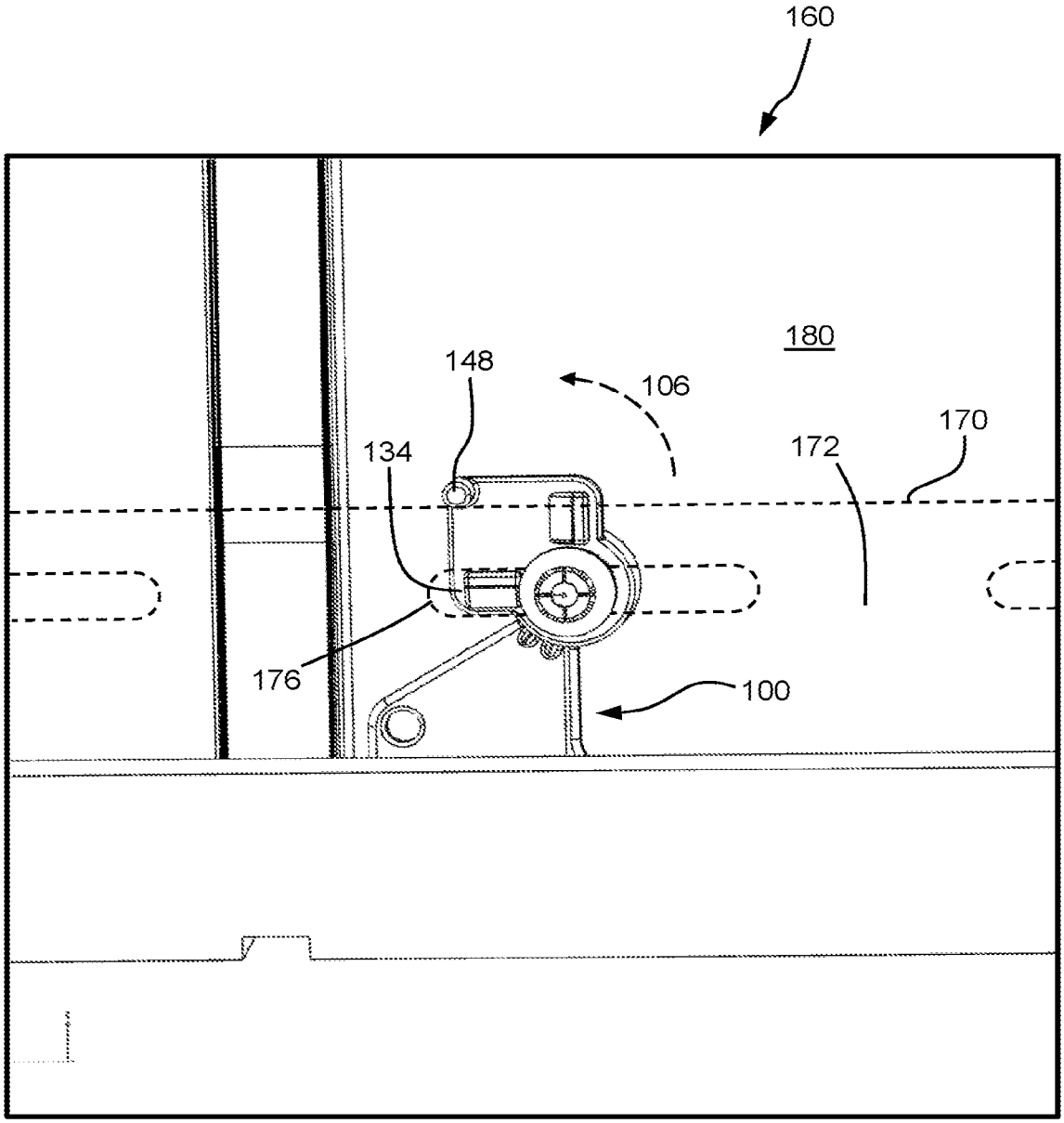
FIG. 8 is a step in a method of using a siding repair clip according to an embodiment of the disclosure.

In certain embodiments of securing a replacement siding panel to an upper siding panel using a siding repair clip as otherwise described herein, rotating the siding repair clip causes the first detent to move into a recess in the replacement siding panel as the siding repair clip is rotated into the locked position. For example, FIG. 8 shows a rear view of a portion of siding system 160 surrounding siding repair clip 100 after siding repair clip 100 has moved into the locked position. As illustrated, first detent 134 is secured in a recess 176 formed by an aperture or nail slot in the fastening strip 172 of replacement siding panel 170. To allow siding repair clip 100 and an upper siding panel 180 to be viewable, replacement siding panel 170 is transparent. Likewise, the upper edge of replacement siding panel 170 as well as the outline of the nail slot that forms recess 176 are both shown using dashed lines. In operation, prior to reaching the locked position, the first detent slides across the fastening strip 172 as the siding repair clip 100 is rotated from the primed position into the locked position. When the first detent 134 reaches the recess 176, the first detent 134 is pushed into the recess and holds the siding repair clip 100 in the locked position to secure the upper siding panel 180 and the replacement siding panel 170 together. In some embodiments, the first detent has a ramped leading edge and a sharp trailing edge. Accordingly, once the first detent enters the recess, the siding repair clip is hindered from returning to the primed position.

While recess 176 in siding panel system 160 is formed by the nail slot or aperture in fastening strip 172 of replacement siding panel 170, in other embodiments, the recess is formed by another structure of the replacement siding panel. For example, in some embodiments, replacement siding panel includes dedicated recess configured to receive the first detent of the siding repair clip. In other embodiments, the first detent of the siding repair clip is configured to interact with another section of the replacement siding panel. Further still, in some embodiments, the first detent of the siding repair clip is configured to cooperate with the upper siding panel in addition or instead of the replacement siding panel.

Figure 9:
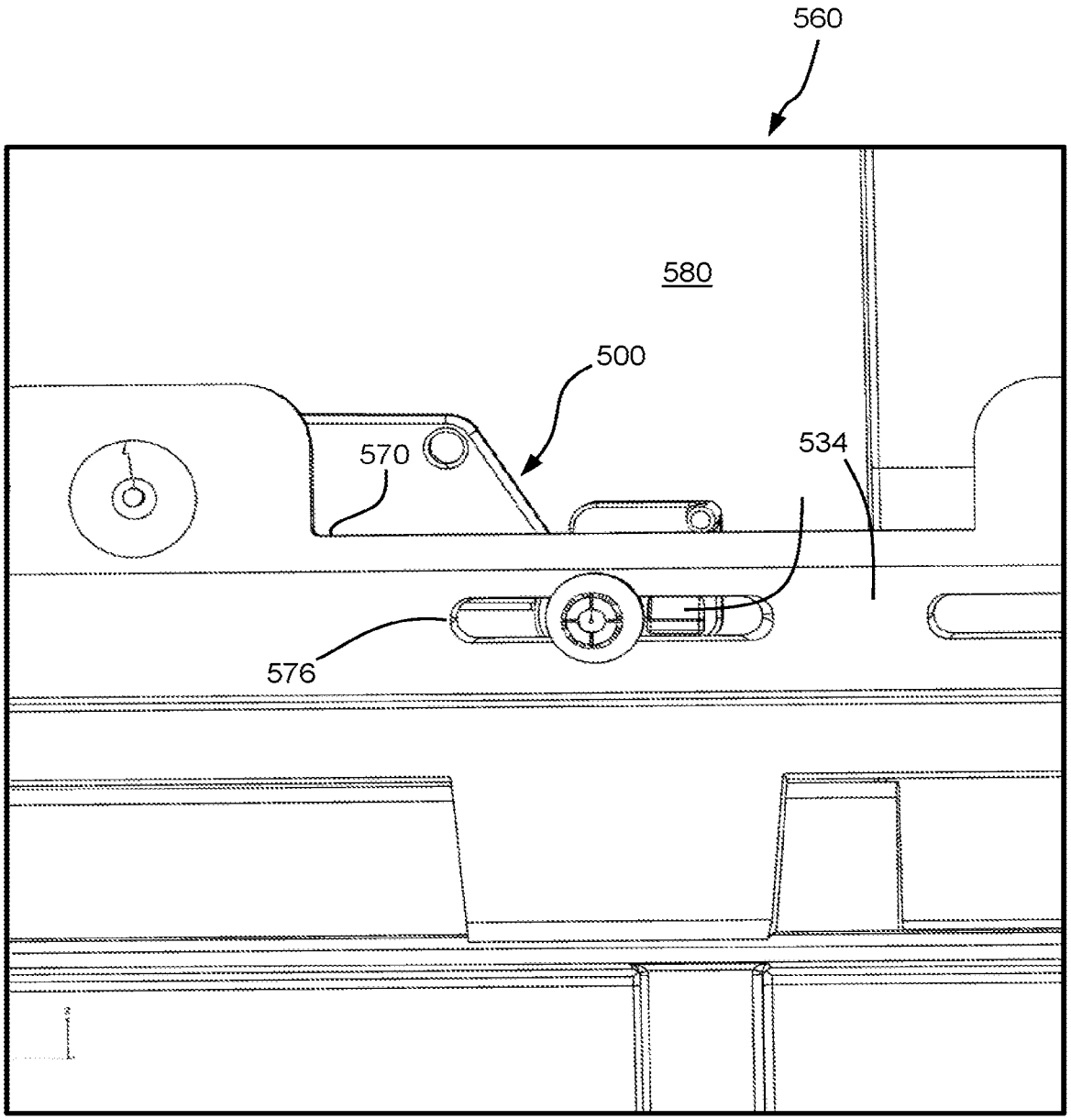
FIG. 9 is a step in a method of using a siding repair clip according to another embodiment of the disclosure.

In certain embodiments of securing a replacement siding panel to an upper siding panel using a siding repair clip as otherwise described herein, rotating the siding repair clip removes the first detent from a recess in the replacement siding panel as the siding repair clip is rotated out of the primed position. For example, FIG. 9 shows a rear view of a portion of a siding system 560 that surrounds siding repair clip 500, introduced in FIG. 5, when the siding repair clip 500 is in the initial primed position. As illustrated, the first detent 534 of siding repair clip 500 is fixed in a recess 576 formed by a nail slot of the replacement siding panel 570, such that siding repair clip 500 is secured in the primed position. Keeping siding repair clip 500 in the primed position allows for the replacement siding panel 570 to be positioned behind the upper siding panel 580 before they are secured together. The first detent 534 is removed from the recess 576 by a force great enough to overcome the friction when rotating siding repair clip 500 from the primed position into the locked position.

In certain embodiments of securing a replacement siding panel to an upper siding panel using a siding repair clip as otherwise described herein, rotating the siding repair clip from the primed position to a locked position overcomes a friction force caused by the first detent. For example, in some embodiments, the first detent presses against a surface of the replacement siding panel when the siding repair clip is in the primed position and friction between the first detent and the siding repair clip holds the siding repair clip in the primed position. In order to rotate the siding repair clip from the primed position, the static friction between the first detent and the surface of the replacement siding panel is overcome by applying a torque to the siding repair clip using the rotating member. Accordingly, in some embodiments the first detent impedes rotation of the siding repair clip without cooperating with any recess.

In certain embodiments of securing a replacement siding panel to an upper siding panel using a siding repair clip as otherwise described herein, the positioning member has a second detent and wherein rotating the siding repair clip removes the second detent from a recess in the replacement siding panel as the siding repair clip is rotated out of the primed position. For example, as shown in FIG. 8, siding repair clip 100 includes a second detent 146 that has been removed from the recess 176 formed by the nail slot in the fastening strip 172 of replacement siding panel 170. Prior to moving in to the locked position, when siding repair clip 100 was in the primed position, second detent 146 was disposed in the recess 176 and held the siding repair clip 100 in the primed position, in a manner similar to the first detent 534 of siding repair clip 500, described above. While, the first detent 134 and second detent 146 both utilize the nail slot of fastening strip 172 as a recess, in other embodiments, the replacement siding panel has an individual recess corresponding to each detent of the siding repair clip.

In certain embodiments of securing a replacement siding panel to an upper siding panel using a siding repair clip as otherwise described herein, the positioning member has a stopper and wherein rotating the siding repair clip from the primed to the locked position is halted by the stopper. For example, as shown in FIG. 8, siding repair clip 100 has been rotated about the hub in the first circumferential direction 106 to the point where stopper 148 is in contact with the upper edge of replacement siding panel 170. As a result, the upper edge of replacement siding panel 170 obstructs stopper 148, thereby preventing further rotation of siding repair clip in the first circumferential direction 106.

In certain embodiments of securing a replacement siding panel to an upper siding panel using a siding repair clip as otherwise described herein, the replacement siding panel has a fastening strip and wherein affixing the replacement siding panel to the support structure comprises securing the fastening strip to the support structure. For example, in some embodiments, the replacement siding panel is secured to the support structure using mechanical fasteners that extend through the fastening strip of the replacement siding panel.

In certain embodiments of securing a replacement siding panel to an upper siding panel using a siding repair clip as otherwise described herein, the fastening strip is secured by nails. For example, in some embodiments, the nails are driven into the support structure using a snake bar or wonder bar and a hammer. For example, the wonder bar or snake bar can be used to lift up the upper siding panel far enough to place the nails into the fastening strip of the replacement siding panel and then the nails can be driven into the support structure by placing the wonder bar, or snake bar on the nail head and hitting the bar with a hammer. In other embodiments, the replacement siding panel is secured to the support structure using another tool.

In certain embodiments of securing a replacement siding panel to an upper siding panel using a siding repair clip as otherwise described herein, the leg includes a rotating member and wherein rotating the siding repair clip comprises applying a force to the rotating member. For example, in some embodiments, once the replacement siding panel is secured to the support structure and the upper siding panel is pressed against the replacement siding panel so that the leg of the siding repair clip is positioned closer to the support structure than the lip of the bottom lock of the upper siding panel, a worker pulls on the rotating member to rotate the siding repair clip into the locked position such that the leg moves into the space between the lip of the bottom lock and the front surface of the upper siding panel.

What is claimed is:

Embodiment 1. A siding repair clip comprising:

a hub configured to be secured to a replacement siding panel so as to be rotatable with respect to the replacement siding panel;

a leg extending from the hub in a first radial direction and configured to engage with a lip of a bottom lock of an upper siding panel;

a positioning member extending from the hub in a second radial direction and including a first detent configured to impede rotation of the hub with respect to the replacement siding panel; and a rotating member configured to rotate the siding repair clip about the hub in a first circumferential direction with respect to the replacement siding panel.

Embodiment 2. The siding repair clip according to embodiment 1, wherein the hub includes a hole for receiving a fastener that is configured to secure the hub to the replacement siding panel.

Embodiment 3. The siding repair clip according to embodiment 2, further comprising a fastener configured to extend through the aperture and secure the hub to the replacement siding panel.

Embodiment 4. The siding repair clip according to any of embodiments 1 to 3, wherein the first detent includes a protrusion that extends in a first axial direction of the siding repair clip.

Embodiment 5. The siding repair clip according to any of embodiments 1 to 3, wherein the first detent includes an arm that extends in a third radial direction and a finger that extends from the arm in a first axial direction.

Embodiment 6. The siding repair clip according to any of embodiments 1 to 5, wherein the first detent is configured to secure the siding repair clip in a locked position.

Embodiment 7. The siding repair clip according to embodiment 6, wherein the first detent includes a ramped edge pointing toward the first circumferential direction and a sharp edge opposite the ramped edge.

Embodiment 8. The siding repair clip according to any of embodiments 1 to 7, wherein the positioning member includes a second detent configured to maintain the siding repair clip in a primed position.

Embodiment 9. The siding repair clip according to any of embodiments 1 to 5, wherein the first detent is configured to maintain the siding repair clip in a primed position.

Embodiment 10. The siding repair clip according to any of embodiments 1 to 9, further comprising a stopper configured to prevent further rotation of the siding repair clip in the first circumferential direction when the siding repair clip is in the locked position.

Embodiment 11. The siding repair clip according to embodiment 10, wherein the stopper is disposed on the positioning member.

Embodiment 12. The siding repair clip according to any of embodiments 1 to 11, wherein the leg includes a stem that extends radially outward from the hub and a foot that extends from the stem in the first circumferential direction.

Embodiment 13. The siding repair clip according to embodiment 12, wherein the foot is angled so as to project in an axial direction.

Embodiment 14. The siding repair clip according to any of embodiments 1 to 13, wherein the hub, leg, and positioning member form a body of the siding repair clip.

Embodiment 15. The siding repair clip according to embodiment 14, wherein the body is integrally formed in a single piece.

Embodiment 16. The siding repair clip according to embodiment 14 or embodiment 15, wherein the rotating member is coupled to the body.

Embodiment 17. The siding repair clip according to embodiment 16, wherein the body includes an aperture and the rotating member is coupled to the aperture.

Embodiment 18. The siding repair clip according embodiment 16 or embodiment 17, wherein the rotating member includes a tension line.

Embodiment 19. The siding repair clip according to any of embodiments 16 to 18, wherein the rotating member is removable from the body.

Embodiment 20. The siding repair clip according to any of embodiments 16 to 19, wherein the leg includes a flange that extends in the second circumferential direction, and wherein the rotating member is coupled to the flange of the leg.

Embodiment 21. The siding repair clip according to any of embodiments 14 to 20, wherein body is formed of a polymer material, such as polycarbonate, polyamide, acrylonitrile butadiene styrene (ABS), polyvinyl chloride (PVC), acrylonitrile styrene acrylate (ASA), or polypropylene.

Embodiment 22. The siding repair clip according to any of embodiments 14 to 20, wherein the body is formed of metal, such as aluminum, tin, steel or another metal.

Embodiment 23. The siding repair clip according to any of embodiments 14 to 22, wherein the thickness of the body of the repair clip is no more than 2 inches, e.g., no more than 1 inch, e.g., no more than 0.5 inches.

Embodiment 24. The siding repair clip according to any of embodiments 1 to 23, wherein a diameter of a hole in the hub is no more than 1 inch, e.g., no more than 0.5 inches.

Embodiment 25. The siding repair clip according to any of embodiments 1 to 24, wherein a length of the leg is no more than 6 inches, e.g., no more than 4 inches, e.g., no more than 2 inches.

Embodiment 26. A siding panel system comprising:

a support structure;

an upper siding panel attached to the support structure, the upper siding panel including a bottom lock having an upwardly extending lip;

a replacement siding panel attached to the support structure; and a siding repair clip according to any of embodiments 1 to 25, wherein the hub of the siding repair clip is secured toward a top of the replacement siding panel, and wherein the leg of the siding repair clip is engaged with the lip of the bottom lock of the upper siding panel so as to hold the bottom lock of the upper siding panel against the replacement siding panel.

Embodiment 27. The siding panel system according to embodiment 26, wherein the hub of the repair clip is secured to a fastening strip of the replacement siding panel.

Embodiment 28. The siding panel system according to embodiment 27, wherein the hub of the siding repair clip is secured to the replacement siding panel using a fastener that passes through an aperture in the replacement siding panel.

Embodiment 29. The siding panel system according to any of embodiments 26 to 28, wherein the lip of the bottom lock of the upper siding panel is disposed behind the leg of the siding repair clip.

Embodiment 30. The siding panel system according to any of embodiments 26 to 29, wherein the siding repair clip is one of a plurality of siding repair clips that hold the bottom lock of the upper siding panel against the replacement siding panel.

Embodiment 31. The siding panel system according to any of embodiments 26 to 30, wherein each of the siding panels are formed of one or more of polypropylene, polyethylene, polyvinyl chloride (PVC), acrylonitrile styrene acrylate (ASA), polyurethane, polycarbonate, or acrylonitrile butadiene styrene (ABS).

Embodiment 32. The siding panel system according to any of embodiments 26 to 31, wherein the support structure is an exterior sheathing.

Embodiment 33. A method of securing a replacement siding panel to an upper siding panel that is attached to a support structure using a siding repair clip according to any of embodiments 1 to 25 so as to form the system of any of embodiments 26 to 32, the method comprising:

positioning the siding repair clip on the replacement siding panel in a primed position;

positioning the replacement siding panel behind the upper siding panel such that the siding repair clip is above the upwardly extending lip of the bottom lock of the upper siding panel;

affixing the replacement siding panel to the support structure;

rotating the siding repair clip from the primed position to a locked position in which the leg of the siding repair clip is engaged with the lip of the bottom lock of the upper siding panel.

Embodiment 34. The method of securing a replacement siding panel to an upper siding panel using a siding repair clip according to embodiment 33, wherein rotating the siding repair clip causes the first detent to move into a recess in the replacement siding panel as the siding repair clip is rotated into the locked position.

Embodiment 35. The method of securing a replacement siding panel to an upper siding panel using a siding repair clip according to embodiment 33, wherein rotating the siding repair clip removes the first detent from a recess in the replacement siding panel as the siding repair clip is rotated out of the primed position.

Embodiment 36. The method of securing a replacement siding panel to an upper siding panel using a siding repair clip according to embodiment 33 to 35, wherein rotating the siding repair clip from the primed position to a locked position overcomes a friction force caused by the first detent.

Embodiment 37. The method of securing a replacement siding panel to an upper siding panel using a siding repair clip according to embodiment 34, wherein the positioning member has a second detent and wherein rotating the siding repair clip removes the second detent from a recess in the replacement siding panel as the siding repair clip is rotated out of the primed position.

Embodiment 38. The method of securing a replacement siding panel to an upper siding panel using a siding repair clip according to embodiments 33 to 37, wherein the positioning member has a stopper and wherein rotation of the siding repair clip from the primed position to the locked position is halted by the stopper.

Embodiment 39. The method of securing a replacement siding panel to an upper siding panel using a siding repair clip according to embodiments 33 to 38, wherein the replacement siding panel has a fastening strip and wherein affixing the replacement siding panel to the support structure comprises securing the fastening strip to the support structure.

Embodiment 40. The method of securing a replacement siding panel to an upper siding panel using a siding repair clip according to embodiment 39, wherein the fastening strip is secured by nails.

Embodiment 41. The method of securing a replacement siding panel to an upper siding panel using a siding repair clip according to embodiments 33 to 40, wherein the siding repair clip further includes a rotating member and wherein rotating the siding repair clip comprises applying a force to the rotating member.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding repair clip for use with a replacement siding panel, the replacement siding panel having a fastening strip disposed along a top edge thereof, the replacement siding panel having a recess formed therein, the siding repair clip comprising:

a hub configured to be secured to the replacement siding panel toward the top edge thereof so as to be rotatable with respect to the replacement siding panel;

a leg extending from the hub in a first radial direction and having a distal end configured to engage with a lip of a bottom lock of an upper siding panel;

a positioning member extending from the hub in a second radial direction and including a first detent configured to impede rotation of the hub with respect to the replacement siding panel and to maintain the siding repair clip in a locked position by the first detent being disposed in the recess, in which the distal end of the leg is disposed distal the fastening strip, and a second detent configured to impede rotation of the hub with respect to the replacement siding panel and to maintain the leg in a primed position by the second detent being disposed in the recess, in which the distal end of the leg is disposed proximal the fastening strip; and a rotating member configured to rotate the siding repair clip about the hub in a first circumferential direction with respect to the replacement siding panel, configured to allow rotation of the siding repair clip from the primed position to the locked position.

2. The siding repair clip according to claim 1, wherein the hub includes a hole for receiving a fastener that is configured to secure the hub to the replacement siding panel.

3. The siding repair clip according to claim 2, further comprising a fastener configured to extend through an aperture of the fastening strip and secure the hub to the replacement siding panel.

4. The siding repair clip according to claim 1, wherein the first detent includes a protrusion that extends in a first axial direction of the siding repair clip.

5. The siding repair clip according to claim 1, wherein the first detent includes a ramped edge pointing toward the first circumferential direction and a sharp edge opposite the ramped edge.

6. The siding repair clip according to claim 1, further comprising a stopper configured to prevent further rotation of the siding repair clip in the first circumferential direction when the siding repair clip is in the locked position.

7. The siding repair clip according to claim 6, wherein the stopper is disposed on the positioning member.

8. The siding repair clip according to claim 1, wherein the leg includes a stem that extends radially outward from the hub and a foot that extends from the stem in the first circumferential direction at the distal end of the leg.

9. The siding repair clip according to claim 8, wherein the foot is angled so as to project in an axial direction.

10. The siding repair clip according to claim 1, wherein the hub, leg, and positioning member form a body of the siding repair clip.

11. The siding repair clip according to claim 10, wherein the rotating member is coupled to the body.

12. A siding panel system comprising:

a support structure;

an upper siding panel attached to the support structure, the upper siding panel including a bottom lock having an upwardly extending lip;

a replacement siding panel attached to the support structure, the replacement siding panel having a fastening strip disposed along a top edge thereof, the replacement siding panel having a recess formed therein; and a siding repair clip according to claim 1, wherein the hub of the siding repair clip is secured toward the top edge of the replacement siding panel, and wherein the siding repair clip is in a locked position in which rotation of the hub with respect to the replacement siding panel is impeded by the first detent being disposed in the recess of the replacement siding panel, and the distal end of the leg of the siding repair clip is engaged with the lip of the bottom lock of the upper siding panel so as to hold the bottom lock of the upper siding panel against the replacement siding panel.

13. The siding panel system according to claim 12, wherein the hub of the siding repair clip is secured to the replacement siding panel using a fastener that passes through an aperture of the fastening strip of the replacement siding panel.

14. A method of securing a replacement siding panel to an upper siding panel that is attached to a support structure so as to form a siding panel system comprising:

a support structure;

an upper siding panel attached to the support structure, the upper siding panel including a bottom lock having an upwardly extending lip;

a replacement siding panel attached to the support structure, the replacement siding panel having a fastening strip disposed along a top edge thereof, the replacement siding panel having a recess formed therein; and a siding repair clip according to claim 1, wherein the hub of the siding repair clip is secured toward the top edge of the replacement siding panel, and wherein the siding repair clip is in a locked position in which rotation of the hub with respect to the replacement siding panel is impeded by the first detent being disposed in the recess of the replacement siding panel, and the distal end of the leg of the siding repair clip is disposed distal the fastening strip and is engaged with the lip of the bottom lock of the upper siding panel so as to hold the bottom lock of the upper siding panel against the replacement siding panel, the method comprising:

positioning the siding repair clip on the replacement siding panel in a primed position in which rotation of the hub with respect to the replacement siding panel is impeded by the second detent being disposed in the recess of the replacement siding panel, and the distal end of the leg is disposed proximal the fastening strip and is not engaged with the lip of the bottom lock of the upper siding panel so as to hold the bottom lock of the upper siding panel against the replacement siding panel;

positioning the replacement siding panel behind the upper siding panel such that the siding repair clip is above the upwardly extending lip of the bottom lock of the upper siding panel;

affixing the replacement siding panel to the support structure;

rotating the siding repair clip from the primed position to the locked position.

15. The siding panel system according to claim 12, wherein the recess is an aperture of the fastening strip of the replacement siding panel.

16. The siding panel system according to claim 15, wherein the siding repair clip is secured through the aperture of the fastening strip of the replacement siding panel.

17. The siding repair clip according to claim 5, wherein the second detent includes a ramped edge pointing toward a first circumferential direction opposing the first circumferential direction, and a sharp edge opposite the ramped edge.

18. The siding panel system of claim 12, wherein the replacement siding panel includes a bottom lock having an upwardly extending lip, and wherein the siding panel system further comprises a lower siding panel having an top lock engaging the lip of the bottom lock of the replacement siding panel.

19. A siding panel system comprising:

a support structure;

an upper siding panel attached to the support structure, the upper siding panel including a bottom lock having an upwardly extending lip;

a replacement siding panel attached to the support structure, the replacement siding panel having a fastening strip disposed along a top edge thereof, the replacement siding panel having a recess formed therein; and a siding repair clip according to claim 1, wherein the hub of the siding repair clip is secured toward the top edge of the replacement siding panel, and wherein the siding repair clip is in a primed position in which rotation of the hub with respect to the replacement siding panel is impeded by the second detent being disposed in the recess of the replacement siding panel, and the distal end of the leg is disposed proximal the fastening strip and is not engaged with the lip of the bottom lock of the upper siding panel so as to hold the bottom lock of the upper siding panel against the replacement siding panel.

20. A siding panel system comprising:

a support structure;

an upper siding panel attached to the support structure, the upper siding panel including a bottom lock having an upwardly extending lip;

a replacement siding panel attached to the support structure, the replacement siding panel having a fastening strip disposed along a top edge thereof, the replacement siding panel having a recess formed therein; and a siding repair clip comprising:

a hub secured to the replacement siding panel toward the top edge thereof so as to be rotatable with respect to the replacement siding panel;

a leg extending from the hub in a first radial direction and having a distal end engaging with the lip of the bottom lock of the upper siding panel;

a positioning member extending from the hub in a second radial direction and including a first detent configured to impede rotation of the hub with respect to the replacement siding panel and to maintain the siding repair clip in a locked position by the first detent being disposed in the recess, in which the distal end of the leg is disposed distal the fastening strip, and a rotating member configured to rotate the siding repair clip about the hub in a first circumferential direction with respect to the replacement siding panel, configured to allow rotation of the siding repair clip between the locked position and a primed position in which the distal end of the leg is disposed proximal the fastening strip and is not engaged with the lip of the bottom lock of the upper siding panel so as to hold the bottom lock of the upper siding panel against the replacement siding panel.

* * * * *